US006722439B2

(12) United States Patent
Garay et al.

(10) Patent No.: US 6,722,439 B2
(45) Date of Patent: Apr. 20, 2004

(54) MULTI-POSITIONED SLIDING SLEEVE VALVE

(75) Inventors: Thomas W. Garay, Humble, TX (US); Jeffry S. Edwards, Houston, TX (US); Michael A. Carmody, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/106,087

(22) Filed: Mar. 26, 2002

(65) Prior Publication Data

US 2003/0183392 A1 Oct. 2, 2003

(51) Int. Cl.[7] ..... E21B 34/19

(52) U.S. Cl. ..... 166/373; 166/320; 166/334.4; 251/290; 251/344

(58) Field of Search ..... 166/373, 334.4, 166/320, 386, 237, 332.1; 251/62, 343, 394, 111, 290

(56) References Cited

U.S. PATENT DOCUMENTS

| | | | | |
|---|---|---|---|---|
| 4,917,191 A | * | 4/1990 | Hopmann et al. | 166/381 |
| 4,942,926 A | * | 7/1990 | Lessi | 166/385 |
| 5,137,086 A | | 8/1992 | Stokley et al. | |
| 5,211,241 A | * | 5/1993 | Mashaw et al. | 166/320 |
| 5,289,875 A | | 3/1994 | Stokley et al. | |
| 5,316,084 A | * | 5/1994 | Murray et al. | 166/332.4 |
| 5,823,263 A | | 10/1998 | Morris et al. | |
| 5,832,996 A | * | 11/1998 | Carmody et al. | 166/53 |
| 5,927,401 A | | 7/1999 | Morris et al. | |
| 5,957,207 A | | 9/1999 | Schnatzmeyer | |
| 5,979,558 A | | 11/1999 | Bouldin et al. | |
| 6,276,458 B1 | | 8/2001 | Malone et al. | |
| 6,308,783 B2 | | 10/2001 | Pringle et al. | |
| 2001/0015276 A1 | | 8/2001 | Pringle et al. | |
| 2001/0054505 A1 | | 12/2001 | Carmody et al. | |
| 2002/0027003 A1 | * | 3/2002 | Williamson et al. | 166/240 |

FOREIGN PATENT DOCUMENTS

WO WO 01/021935 A1 3/2001

OTHER PUBLICATIONS

Halliburton Brochure, "Intelligent Completions Technology" 5 pages, 1999, 2000.
Schlumberger Brochure, "Advanced Completion Technologies Brochure" 24 pages, Apr. 2001.

* cited by examiner

*Primary Examiner*—David Bagnell
*Assistant Examiner*—Daniel P Stephenson
(74) *Attorney, Agent, or Firm*—Steve Rosenblatt

(57) ABSTRACT

A downhole choke in the form of a sliding sleeve valve operable in a plurality of positions including fully open, fully closed, and positions in between, is disclosed. It features a hydraulic control system that, in one embodiment, provides the motive force to move the sliding sleeve a predetermined amount for a given applied control pressure. Further increments in applied pressure result in further predetermined movements of the sliding sleeve. In another embodiment, the sliding sleeve lands in a series of grooves in the surrounding housing depending on the degree of pressure applied to the control system.

21 Claims, 6 Drawing Sheets

MULTI-POSITIONED SLIDING SLEEVE VALVE

FIELD OF THE INVENTION

Figure 1A:
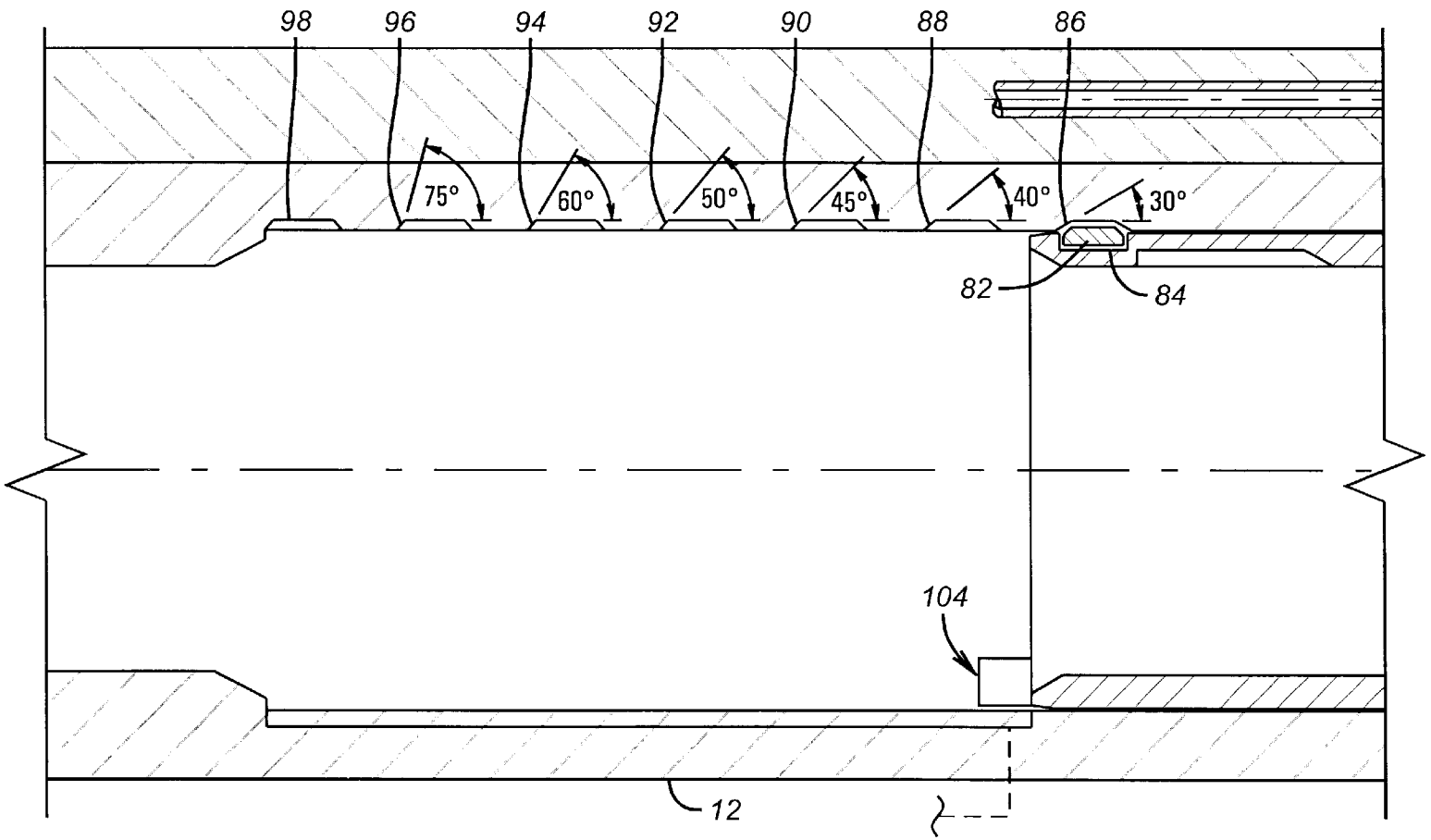

The field of this invention is downhole choke valves and more particularly, sliding sleeve valves that can be selectively positioned in an open, closed, or other positions in between, from the surface.

BACKGROUND OF THE INVENTION

It is often desirable to control the flow rate into production tubing from one or more producing zones. Going in the reverse direction, the injection rates from surface tubing into the formation also need to be controlled. One way this is accomplished is with a choke. A choke is a variable orifice. One form of downhole valve or choke is a sliding sleeve valve. In the early days, these valves featured a sliding sleeve with an opening. The sliding sleeve moved between a fully open and fully closed position and could be shifted in a variety of ways. Tools could be lowered from the surface to shift the sleeve or some sort of hydraulic system could be used for that same purpose.

The early sliding sleeve designs lacked the ability to obtain positions intermediate to the fully open and fully closed positions. Accordingly, chokes, not necessarily involving sliding sleeves were developed, which could assume intermediate positions for throttling purposes. One design uses a form of a J-slot mechanism operable by application and removal of hydraulic pressure to selectively align more or less of the ports in a sleeve with the opening in the housing. This design is illustrated in FIGS. 9*a* and 15 of U.S. Pat. No. 6,308,783. Other designs involve a series of valves operable electrically or hydraulically and mounted in a side pocket mandrel. Examples of this style are the WRFC valve offered by Schlumberger. Schlumberger also offers the TRTFC, which is a choke operating on a form of an indexer pin guiding an indexer to put the valve in different positions. Other well control variable choke devices are illustrated in U.S. Pat. Nos.: 5,823,263; 5,927,401; 5,957,207; 5,979,558; and 6,276,458. Finally, Halliburton manufactures the IV-ICV, which it advertises to be infinitely variable when used in interval control service.

The present invention provides a downhole choke valve that is adjustable in a variety of positions. It features simplicity in design and responsiveness to incremental increases in control system pressure to attain varying degrees of opening. A fully hydraulic and a combination mechanical and hydraulic embodiment are described below. Those skilled in the art will be better able to appreciate the invention from a review of the preferred embodiment described below.

SUMMARY OF THE INVENTION

A downhole choke in the form of a sliding sleeve valve operable in a plurality of positions including fully open, fully closed, and positions in between, is disclosed. It features a hydraulic control system that, in one embodiment, provides the motive force to move the sliding sleeve a predetermined amount for a given applied control pressure. Further increments in applied pressure result in further predetermined movements of the sliding sleeve. In another embodiment, the sliding sleeve lands in a series of grooves in the surrounding housing depending on the degree of pressure applied to the control system.

DETAILED DESCRIPTION OF THE DRAWINGS

Figure 1B:
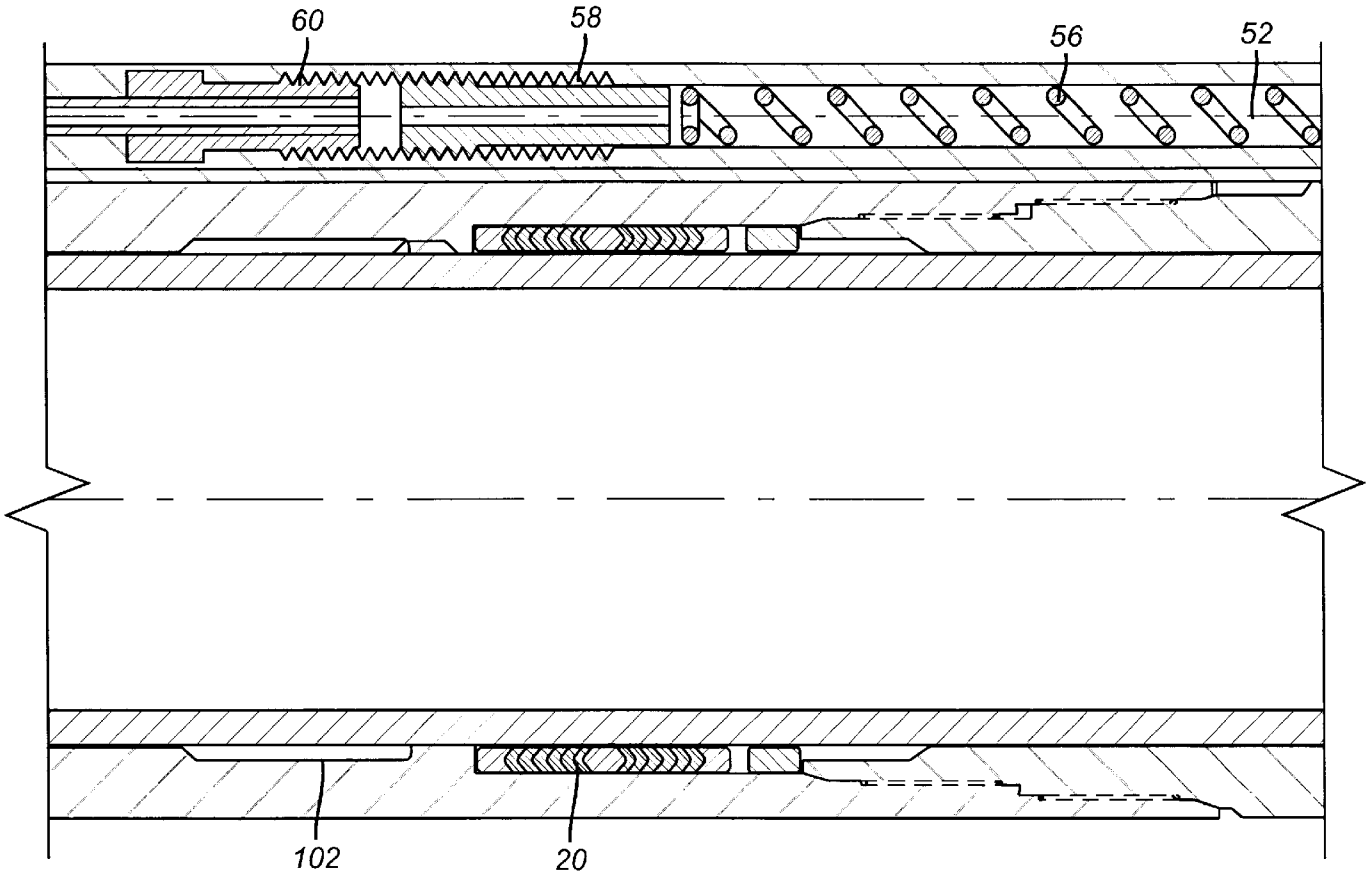
Figure 1C:
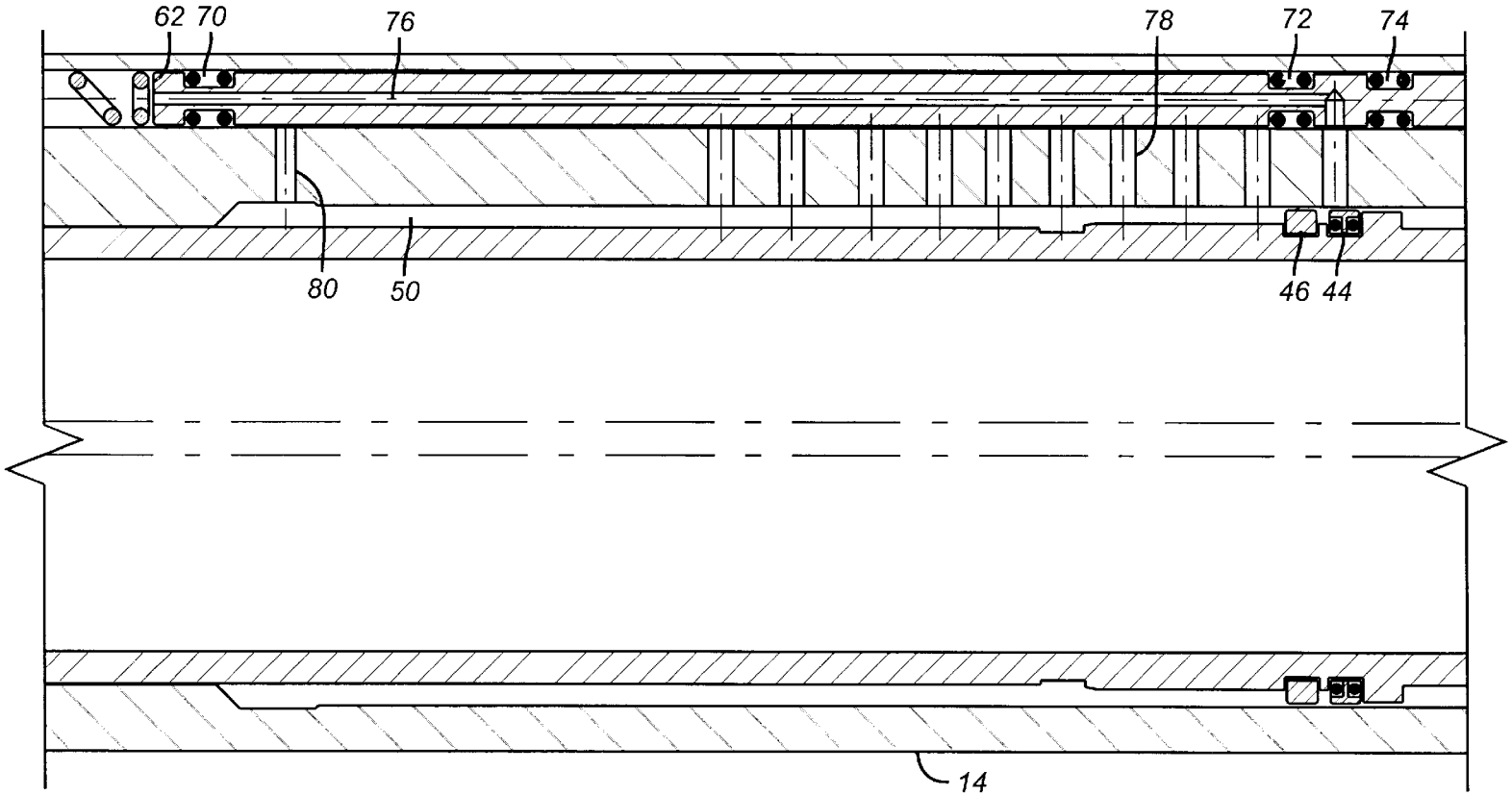
Figure 1D:
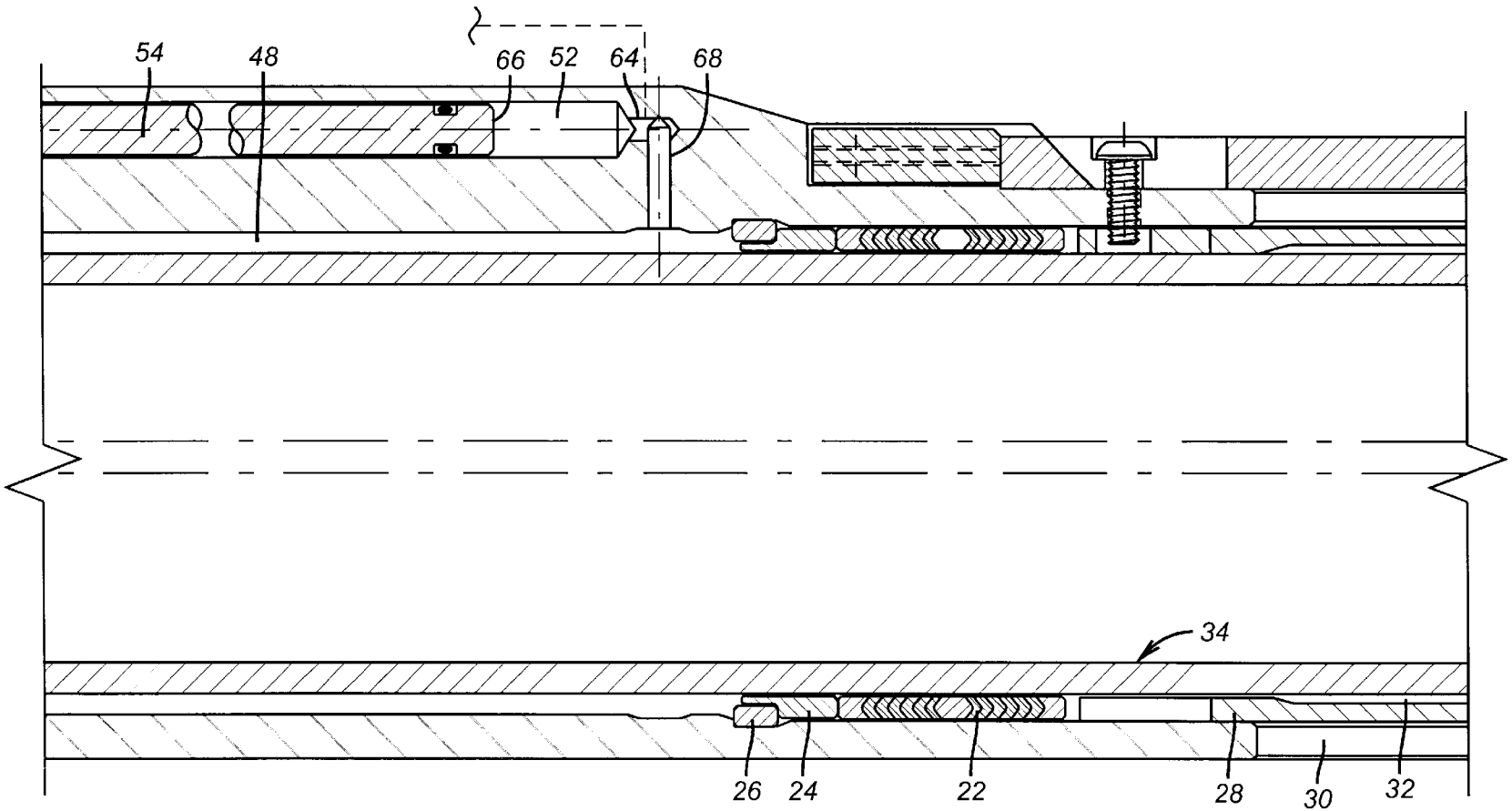
Figure 1E:
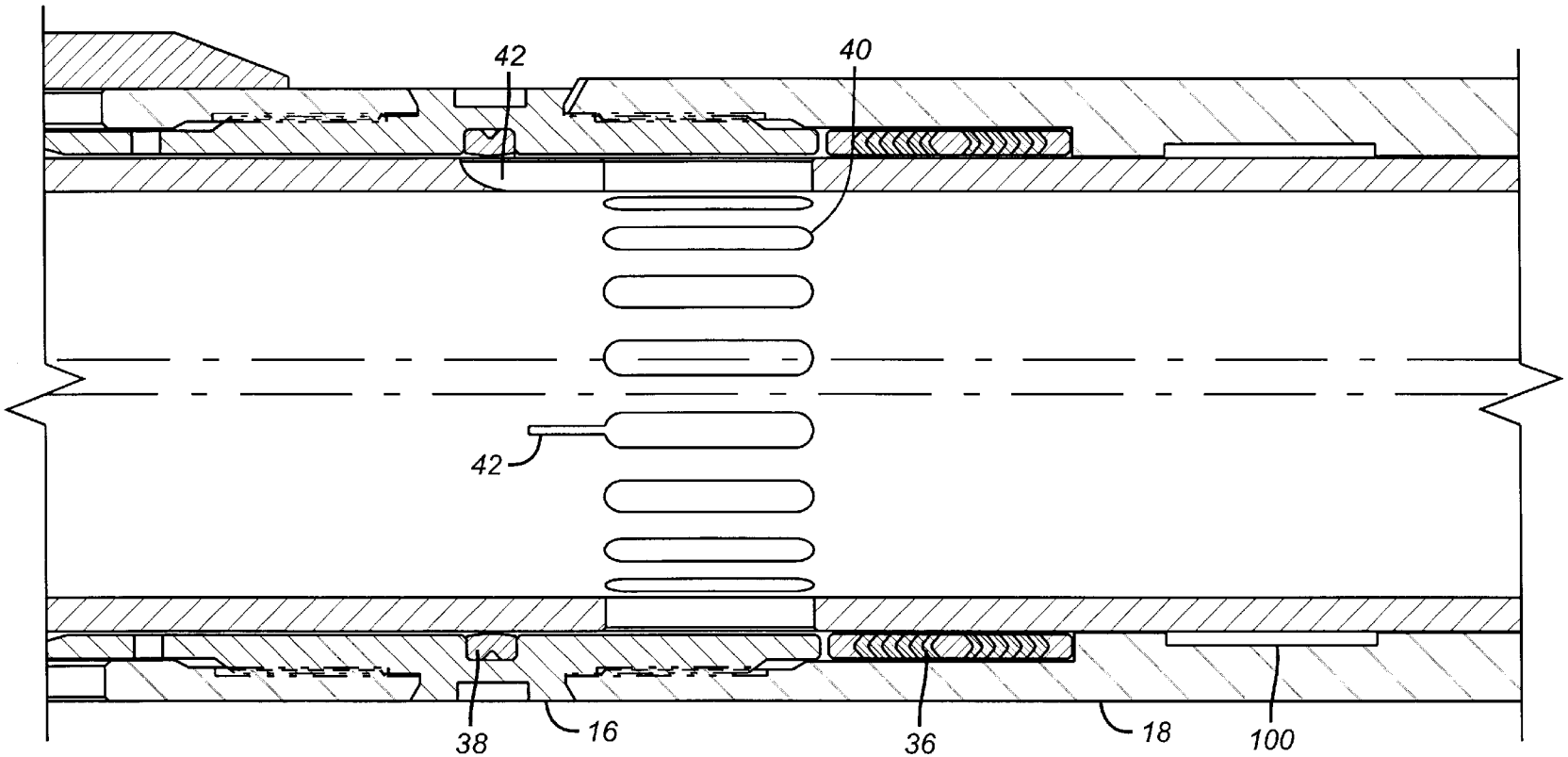
Figure 1F:
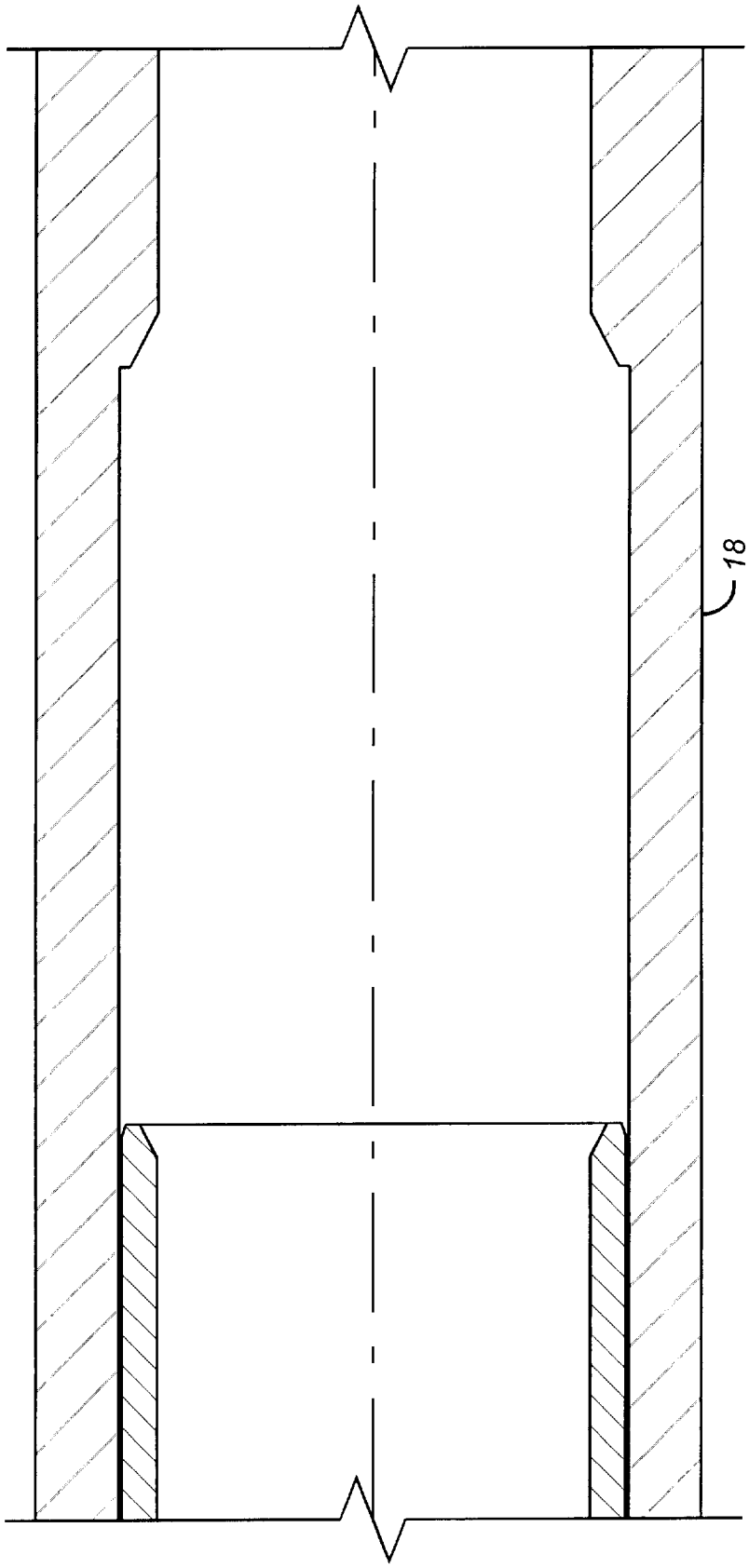

FIGS. 1*a*–1*f* are a section view illustrating the adjustable choke in the form of a sliding sleeve in two embodiments.

DETAILED DESCRIPTION OF THE PREFERRED EMBODIMENT

Referring to FIG. 1, the housing assembly 10 has a top sub 12 connected to a body 14. The body 14 is connected to diffuser sub 16, which is, in turn, connected to bottom sub 18. Tubing from the surface (not shown) is connected to top sub 12, while other downhole tools (not shown) can be connected to bottom sub 18. Between top sub 12 and body 14 a top seal 20 is retained. A middle seal 22 is retained by ring 24 and snap ring 26 against seal spacer 28, which is, in turn, pushed against diffuser sub 16. Ports 30 can be on 90 degree spacing or any other spacing depending on the number of ports used and flow into any such ports is circumferentially distributed by the diffuser sub 16 into annular space 32 between the body 14 and the sliding sleeve 34. A lower seal 36 is retained between the diffuser sub 16 and the bottom sub 18. A diffuser ring 38 is retained by diffuser sub 16. It created a small annular clearance for the onset of flow from ports 30.

Those skilled in the art will realize that the fully closed position has the sleeve 34 shifted further down than illustrated, such that elongated openings 40 and their elongated extensions 42 are fully below lower seal 36. As the sleeve 34 is shifted uphole, as will be explained below, the first to clear lower seal 36 are the elongated extensions 42. Ultimately, extensions 42 clear the diffuser ring 38. At this time the entire ports 40 have cleared lower seal 36 and the seal 36 is protected from flow effects since ports 40 have moved beyond it. This is the precise position shown in FIG. 1*e*. The purpose of the extensions 42 and the flow diffuser 28 is to reduce fluid velocity between ports 30 and 40 until ports 40 pass completely over seals 36 as high velocity fluid impinging on the seals 36 could damage them, especially when high differential pressures are present. Once the ports 40 move past seal 36, there is no longer a risk of damage to lower seal 36 from high velocity fluids and the diffuser ring 38 and the elongated extensions have served their purpose. This is the view shown in FIG. 1*e*.

The sliding sleeve 34 has a seal 44 held by a snap ring 46. Seal 44 divides annular spaces 48 and 50. Annular space 48 is between middle seal 22 and seal 44, while annular space 50 is between upper seal 20 and seal 44. Body 14 also features a piston bore 52, within which piston 54 reciprocates against the bias of spring 56. An adjusting screw 58 can alter the preload on spring 56. Connection 60 allows closing pressure from the surface to be applied via a control line (not shown) to the top 62 of piston 54. Connection 64 communicates with the bottom 66 of piston 54 and, through passage 68 into annular space 48. Piston 54 has upper seals 70 and lower seals 72 and 74. Vent passage 76 extends from top 62 of piston 54, through seal 70 and laterally out the side of piston 54 between seals 72 and 74. A plurality of spaced adjusting ports or vent passages 78 extend from piston bore 52 into annular space 48 or 50 depending on position of sleeve 34, as will be explained below. A close passage 80 connects annular space 50 to piston bore 52 either above or below seal 70, depending on the position of piston 54.

Looking at the top of sleeve 34, there is a C-ring 82 in a groove 84. As the sleeve 34 moves, the C-ring 82 sequentially expands into grooves 86, 88, 90, 92, 94, 96, and 98. As shown in FIG. 1 each groove has a steeper angle that C-ring 82 must climb to advance the sleeve 34 to a larger open position. The angles get progressively larger as the percentage open position increases. These angular differences between adjacent slots, in turn, require incrementally higher pressure at connection 64 to obtain further movement of the sleeve 34. Thus one way to obtain multiple positions of sleeve 34 is to use the C-ring 82 in conjunction with multiple grooves 86 to 98 with a varying exit angle in each groove. This technique can be used in isolation or in combination with the operation using the adjusting ports 78, as will be described below.

From the fully closed position, control line pressure is applied at connection 64 into piston bore 52. This pressure also enters annular space 48 through passage 68. The sliding sleeve 34 is forced up by pressure in annular space 48 against seal 44, which is attached to sliding sleeve 34. The upward movement of sleeve 34 is made possible by fluid displacement from annular space 50 through passage 76. The piston 54 is forced up against spring 56, whose spring force increases as pressure is increased into connection 64. The movement of sleeve 34 with piston 54 stationary due to the force of spring 56 eventually moves seal 44 up to passage 76 that extends laterally between seals 72 and 74. As this happens, annular space 50 is in fluid communication through passage 76 with connection 60 to vent annular space 50 to allow sleeve 34 with seal 44 to move up. When seal 44 reaches or covers passage 76 the driving pressure for sleeve 34 that is in annular space 48 can be vented through passage 76 between seals 72 and 74. At the same time, annular space 50 can become isolated and the pressure in it builds, stopping further progress of sleeve 34. Friction from seal 44 can also contribute to stopping sleeve 34. Piston 54 holds its position against spring 56 unless the applied pressure through port 64 is increased. If that happens, the piston 54 can shift, to move the outlet of passage 76 into alignment with another adjusting port 78 to a position where pressure buildup can occur on annular passage 48 thus moving sleeve 34 again to a more open position by applying pressure to its seal 44. In this manner, different applied pressure levels at connection 64 can result in different end positions of the piston 54 and the sleeve 34. To achieve the full open position, pressure to a high level is applied to connection 64. The piston is displaced far enough to align passage 76 with the uppermost adjusting port 78. Pressure from connection 64 can pressurize annular space 48 and apply a force to seal 44 while annular space 50 is vented through passage 76 to connection 60. The fully closed position is reached by pressurizing connection 60 to drive down piston 54. Close port 80 is exposed to connection 60. Pressure in connection 60 enters annular space 50 to push down on seal 44. Annular space 48 displaces fluid out connection 64 as the sleeve 34 is pushed down moving elongated openings 40 and extensions 42 beyond lower seal 36 to isolate ports 30. This positioning system for the sleeve 34 can be used in isolation or in tandem with the C-ring 82 and its associated grooves. Preferably, the control system with the adjusting ports 78 is used in isolation. Either system has few moving parts and permits reliable and repeatable operation.

The range of angles in grooves 86–98 can have any desired range and increments until travel stops for sleeve 34 when C-ring 82 enters groove 98. For example groove 86 can have an angle of 30 degrees, with subsequent grooves having exit angles increasingly steeper such as 40, 45, 50, 60, 75 and 90 degrees in groove 98. The larger the angle the more force is required to snap the C-ring 82 out of that groove.

Upper sub 12 and Lower sub 18 also features grooves to allow a place for any debris to accumulate in a manner that it will not impede the movement of the sliding sleeve 34. The debris can settle on the inner wall of the housing 10 as the sliding sleeve 34 strokes between its end positions.

Those skilled in the art will appreciate that if only the system of the C-ring 82 in conjunction with grooves 86–98 are used, the actuating system for the sleeve 34 can be varied and made more simple. In a two control line system, the sleeve 34 can be driven by pressure applied to one control line or the other with the result being a pressurization of either annular space 48 or 50 for motion in the desired direction by sleeve 34. This system provides feedback at the surface because the control line pressure must rise to get the C-ring 82 to jump out of one of the grooves 86–96. The adjusting ports 78 can be eliminated and even the piston 54 can be eliminated. Pressure applied to connections 60 or 64 can go directly to annular spaces 48 or 50 to urge the sliding sleeve 34 in the desired direction. Additionally, no matter which combination is used, provisions can be made to return the sleeve to a desired fail-safe position, in the event of failure of control line pressure, seal leakage, or other component failure downhole. The sliding sleeve 34 may have a bias applied to it by a spring or pressurized gas referred to as a "dome charge" to urge it to its fail-safe position in the event of loss of control pressure or other downhole malfunction.

In using either system alone or both together, a downhole position sensing and transmitting system to the surface, shown schematically as 104, can be used to tie into the hydraulic system supplying pressure to connections 60 and 64 as a form of feedback for proper positioning of the sliding sleeve 34. Positioning transducers may be used to send the position signal to the surface where a computer can process such signal and alter the pressures delivered to connections 60 or 64.

The foregoing disclosure and description of the invention are illustrative and explanatory thereof, and various changes in the size, shape and materials, as well as in the details of the illustrated construction, may be made without departing from the invention, whose scope is determined by the claims that appear below.

We claim:

1. A multi-position downhole choke, comprising:

a body having a flow passage and a first port;

a sliding sleeve having a second port for selective alignment with at least part of said first port to define multiple open positions and for complete misalignment with said first port to define a fully closed position;

a control system on said body for moving said sliding sleeve a predetermined amount relative to said body before being stopped by said body in multiple open positions wherein the degree of movement is predetermined on the amount of pressure acting on said sliding sleeve from said control system.

2. The choke of claim 1, further comprising:

a hydraulic pressure release device at least in part on said body to stop movement of said sliding sleeve at a predetermined distance depending on the value of input pressure applied to said sleeve from said control system.

3. The choke of claim 1, further comprising:

a mechanical braking device at least in part on said body to stop movement of said sliding sleeve at a predetermined distance depending on the value of input pressure applied to said sleeve from said control system.

4. The choke of claim 3, wherein:

said mechanical braking device comprises a plurality of detents for said sleeve to selectively retain said sleeve against a predetermined level of pressure applied to said sleeve by said control system.

5. The choke of claim 4, wherein:

said detents comprise a plurality of grooves on one of said body and said sliding sleeve and an extending member on the other of said body and said sliding sleeve, said extending member exiting one groove and entering another groove upon a change in applied pressure to said sleeve from said control system.

6. The choke of claim 1, comprising:

at least one seal on said body adjacent to said first port, said closed position defined by said second port being disposed on the opposite side of said seal than said first port, and a flow restrictor for the annular space between said sliding sleeve and said body mounted between said first port and said seal, to regulate initial flow rates as said second port moves beyond said seal.

7. The choke of claim 6, wherein:

said second port comprises an elongated extension which first passes said seal as said sliding sleeve moves away from said closed position.

8. The choke of claim 1, further comprising:

a hydraulic braking device further comprising a plurality of seals between said body and said sleeve with at least one sliding sleeve mounted seal to create an upper and a lower variable volume annular spaces between said body and said sliding sleeve, said annular spaces selectively receiving fluid pressure from said control system for urging said sliding sleeve in opposed directions;

said movement of said sleeve being arrested when said annular space not receiving applied pressure from said control system has a vent passage thereon closed up.

9. A multi-position downhole choke, comprising:

a body having a flow passage and a first port;

a sliding sleeve having a second port for selective alignment with at least part of said first port to define multiple open positions and for complete misalignment with said first port to define a fully closed position;

a control system on said body for moving said sliding sleeve a predetermined amount relative to said body wherein the degree of movement is predetermined on the amount of pressure acting on said sliding sleeve from said control system;

a mechanical braking device at least in part on said body to stop movement of said sliding sleeve at a predetermined distance depending on the value of input pressure applied to said sleeve from said control system; said mechanical braking device comprises a plurality of detents for said sleeve to selectively retain said sleeve against a predetermined level of pressure applied to said sleeve by said control system;

said detents comprise a plurality of grooves on one of said body and said sliding sleeve and an extending member on the other of said body and said sliding sleeve, said extending member exiting one groove and entering another groove upon a change in applied pressure to said sleeve from said control system;

a plurality of said grooves have exit surfaces that generally slope at different angles with respect to a longitudinal axis of said body.

10. The choke of claim 9, wherein:

said grooves are distinct, aligned with each other and axially spaced with respect to said longitudinal axis of said body and have progressively larger exit angles on said exit surfaces which require progressively higher pressure to move said extending member through said grooves.

11. The choke of claim 9, wherein:

said grooves are disposed on said body and said sliding sleeve comprises a split ring that is forced along an exit surface into an adjacent groove until the applied pressure from said control system applies a force required to collapse said split ring on an exit surface having a predetermined slope.

12. A multi-position downhole choke, comprising:

a body having a flow passage and a first port;

a sliding sleeve having a second port for selective alignment with at least part of said first port to define multiple open positions and for complete misalignment with said first port to define a fully closed position;

a control system on said body for moving said sliding sleeve a predetermined amount relative to said body wherein the degree of movement is predetermined on the amount of pressure acting on said sliding sleeve from said control system;

a hydraulic pressure release device at least in part on said body to stop movement of said sliding sleeve at a predetermined distance depending on the value of input pressure applied to said sleeve from said control system;

said hydraulic pressure release device further comprises a plurality of seals between said body and said sleeve with at least one sliding sleeve mounted seal to create an upper and a lower variable volume annular spaces between said body and said sliding sleeve, said annular spaces selectively receiving fluid pressure from said control system for urging said sliding sleeve in opposed directions;

said movement of said sleeve being arrested when one of said annular spaces has a vent passage thereon opened up.

13. The choke of claim 12, wherein:

movement of said sliding sleeve opens said vent passage.

14. The choke of claim 13, wherein:

said body comprises a plurality of vent passages axially displaced with respect to said longitudinal axis and in fluid communication with one of said annular spaces on one end and a piston bore on the other end;

a piston movably mounted in said bore to enable a predetermined vent passage.

15. The choke of claim 10, wherein:

applied pressure from said control system to a predetermined level positions said piston against a bias to enable a predetermined vent passage.

16. The choke of claim 15, wherein:

said applied pressure against said bias on said piston also drives said sliding sleeve by pressurizing one of said annular spaces while the other of said annular spaces is vented through a vent passage predetermined by the position of said piston.

17. The choke of claim 4, wherein:

pressure applied by said control system to urge said sliding sleeve away from a fully closed position is applied to said piston and said lower annular space simultaneously, said upper annular space is vented through said predetermined vent passage selected by piston movement and pressure in said lower annular space acting on said seal mounted to said sliding sleeve moves said sliding sleeve until said seal on said sliding sleeve reaches said predetermined vent passage.

18. The choke of claim 17, wherein:

said seal on said sliding sleeve opens said predetermined vent passage to said lower annular space to stop movement of said sliding sleeve.

19. The choke of claim 18, wherein:

said bias on said piston comprises a spring such that different pressures applied to said piston against said spring result in different movements of said piston to expose different vent passages.

20. The choke of claim 19, wherein:

said control system comprises a first inlet in fluid communication with one end of said piston and said lower annular space and a second inlet in fluid communication between an opposite end of said piston and selectively with said upper annular space, said spring acting on said opposite end of said piston, whereupon pressure applied at said second inlet displaces said piston in conjunction with said spring to provide access to said second annular space for displacement of said sliding sleeve towards said closed position.

21. The choke of claim 14, wherein:

said piston has a passage through it that emerges at one passage end between a pair of piston seals, whereupon a vent passage is selected for one of said annular spaces when a vent passage in said body is aligned with said passage end in said piston.

* * * * *